United States Patent [19]

Goto et al.

[11] Patent Number: 4,827,825

[45] Date of Patent: May 9, 1989

[54] TUNING PEG

[75] Inventors: Takao Goto, Isezakishi; Jun Sekino, Tokyo, both of Japan

[73] Assignee: Gotoh Gut Yugen Kaisha, Gunmaken, Japan

[21] Appl. No.: 235,303

[22] Filed: Aug. 23, 1988

[30] Foreign Application Priority Data

Sep. 2, 1987 [JP] Japan ..... 62-221130

[51] Int. Cl.[4] ..... G10D 3/14

[52] U.S. Cl. ..... 84/306

[58] Field of Search ..... 84/304–306

[56] References Cited

U.S. PATENT DOCUMENTS

| | | | |
|---|---|---|---|
| 532,053 | 1/1895 | Hafer et al. | 84/305 |
| 542,157 | 7/1895 | Gosse | 84/306 |
| 554,057 | 2/1896 | Durkee | 84/304 |
| 1,732,172 | 10/1929 | Smith | 84/304 |
| 1,743,007 | 1/1930 | Sparkes | 84/305 |
| 4,026,182 | 5/1977 | Gilbrech | 84/305 |
| 4,098,163 | 7/1978 | Kato | 84/306 |
| 4,151,778 | 5/1979 | Beattie et al. | 84/306 |
| 4,191,086 | 3/1980 | Spercel | 84/306 |
| 4,674,387 | 6/1987 | Caruth | 84/304 |

FOREIGN PATENT DOCUMENTS

| | | |
|---|---|---|
| 54-1222 | 1/1979 | Japan . |
| 59-90997 | 6/1984 | Japan . |
| 60-8986 | 1/1985 | Japan . |

*Primary Examiner*—Lawrence R. Franklin

*Attorney, Agent, or Firm*—Wenderoth, Lind & Ponack

[57] ABSTRACT

A tuning peg for stringed instruments having a core shaft which is rotated as a string spool shaft by a manually-operated knob and an outer sleeve which is externally mounted on the core shaft. The top surface of the core shaft is formed as a string receiving surface and at least the lower part of the core shaft is formed as a threaded pulling part. At least the lower part of the outer sleeve is made as an internal thread part which engages with the threaded pulling of the core shaft and the trunk part of the outer sleeve is provided with a string passing hole which is open in the orthogonal direction to the axis of the outer sleeve and the ceiling surface of the string passing hole inside the outer sleeve is formed as a string pushing surface. When a string is passed through the string passing hole and the knob is rotated, the outer sleeve lowers and the string pushing surface pushes the string onto the string receiving surface.

4 Claims, 4 Drawing Sheets

TUNING PEG

BACKGROUND OF THE INVENTION

The present invention relates to a tuning peg for used in a stringed instrument such as a guitar, particularly a tuning peg for clamping a string.

The conventional tuning peg, for example, as disclosed in the Japanese Utility Model Gazette for Public Inspection No. SHO 54-1222 has a string spool shaft for winding a string and a knob which rotates the string spool shaft to wind up and unwind the string, and generally the knob and the string spool shaft are connected with the worm gear.

Such tuning peg is usually provided with a string passing hole in the trunk part of the string spool shaft in the orthogonal direction to the axis so that the string is wound around the string spool shaft by rotating the string spool shaft after the string has been passed through the string passing hole.

However, said string passing hole is used only for freely inserting the string and such simple insertion of the string does not allow winding up of the string due to slipping. For example, it has been necessary for the instrument player to wind the string several times around the string spool shaft while holding an end of the string until the string is tightly engaged with the string spool shaft and then extend and tauten the string.

Consequently, it has been disadvantageous in that said string fixing work is troublesome and the string which has been completely extended and tautened or adjusted is often slackened during winding, thus resulting in a disorder of musical scale.

Therefore, lately it has been suggested to use a tuning peg which is adapted to clamp under pressure an end of said string inside the string spool shaft to avoid slipping of the string. This tuning peg is disclosed, for example, in the Japanese Patent Gazette (Laid-Open) No. SHO 59-184395 and Japanese Utility Model Gazette (Laid-Open) No. SHO 60-8996.

In the tuning peg which is constructed to clamp said string end under pressure, a fixing member such as a clamp nut or a clamp cap which is thread-fitted to the string spool shaft is used as a means for fixing the string end to the string spool shaft and the string spool shaft is rotated in the string winding direction by operating the knob after firmly fixing the string end to said string spool shaft with this fixing member.

Accordingly, there has been a problem that it is unavoidable that a force in a twisting direction due to rotation of the fixing member is applied to a part where the string end is to be fixed and the string end is therefore weakened and cut or that a finger force for fixing the string end with the fixing member is excessively large to result in cutting of the string.

SUMMARY OF THE INVENTION

An object of the present invention is to provide a tuning peg with which a string winding operation is extremely simple.

For the purpose of the present invention, the string spool shaft around which a string is wound is designed to comprise a core shaft capable of being rotated by manually operating a knob and an outer sleeve which is externally mounted on said core shaft, at least the lower part of said core shaft being formed as an external thread part and at least the lower part of said outer sleeve being formed as an internal thread part, thereby said outer sleeve is mounted on said core shaft and provided with a string passing hole in the orthogonal direction to the axis of the outer sleeve so that the string end is passed through said string passing hole.

The top surface of said core shaft is formed as a string receiving surface and the ceiling surface of said string passing hole is formed as the string pushing surface which contacts or parts away from said string receiving surface.

Since the tuning peg in accordance with the present invention is constructed as described above, the outer sleeve is pulled down in the external thread part of the core shaft and the string end is pushed against the string receiving surface by the string pushing surface when the string end is passed through the string passing hole and the knob is rotated. Accordingly, the player can take up the string around the string spool shaft merely by rotating the knob after inserting the string end into the string passing hole.

Another object of the present invention is to provide a tuning peg capable of preventing the string end from being cut by a force for fixing the string end.

In the tuning peg in accordance with the present invention, a force for fixing the string end with a clamping pressure is a frictional force produced between the string end where the tension of the string is obtained as a factor and the string pushing surface and the string receiving surface, and accordingly an excessive clamping force by fingers is not added to the string end and a trouble that the string end is cut by the clamping pressure can be prevented.

Another further object of the present invention is to a tuning peg with which a twisting force to be applied to the string end is small.

In the tuning peg in accordance with the present invention, the string end does not receive any force until it is held by and between the string pushing surface and the string receiving surface and a force clamping the string end is always applied in the axial direction of the core shaft except for an extremely short duration of time upon final application of the clamping force. For this reason, the force in the twisting direction to be applied to the string end can be extremely reduced.

Another further object of the present invention is to provide a tuning peg capable of preventing said outer sleeve from falling off from said core shaft.

For this purpose of the present invention, a threaded guide part is provided with a diameter-reduced part at the upper side of the threaded pulling part provided at the lower part of said core shaft and the internal thread part of said outer sleeve comes to engage with said threaded pulling part after having passed through said threaded guide part.

Accordingly, the outer sleeve is prevented from falling off from the core shaft by the threaded guide part after it has passed through said threaded guide part.

BRIEF DESCRIPTION OF THE DRAWINGS

The present invention is briefly described referring to the accompanying drawings whereof.

PREFERRED EMBODIMENT OF THE INVENTION

Figure 1:
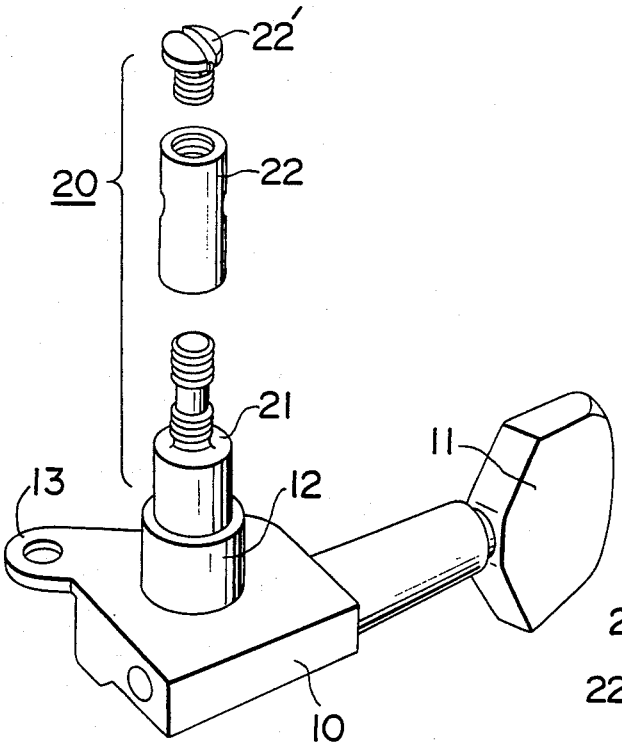
FIG. 1 is a disassembled perspective view of the tuning peg in accordance with the present invention.

FIG. 1 is the perspective view of the tuning peg in accordance with the present invention in which the housing 10 is provided with the manually-operated knob 11, shaft retaining hole 12 and mounting piece 13 for mounting the housing onto the stringed instrument. The core shaft 21 of the string spool shaft is inserted in said shaft retaining hole 12 and a gear is provided as the insertion end of this core shaft 21 and engaged in the housing 10 with the worm gear which is rotated by the knob 11. The mechanism for rotating the core shaft 21 by the knob 11 as described above can be satisfied with a conventional known construction and the description is omitted in this case.

Figure 5:
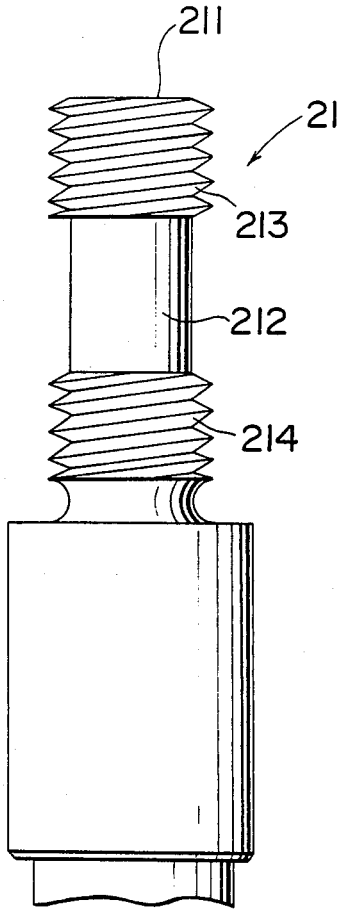
FIG. 5 is a front view showing the core shaft of said string spool shaft.

Said core shaft 21 is constructed, as shown in FIGS. 1 and 5, so that its top surface is formed as a smooth string receiving surface 211 and the diameter-reduced part 212 is provided at the center of the trunk part whereby the threaded guide part 213 is provided above this diameter-reduced part 212 and the threaded pulling part 214 is provided at the lower part of the diameter-reduced part 212.

Figure 4:
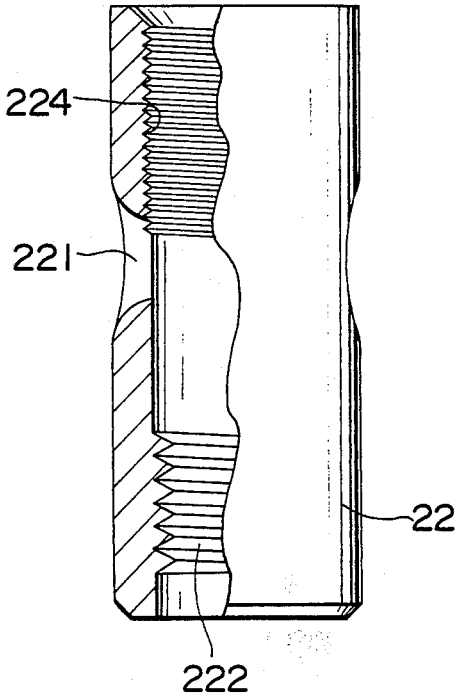
FIG. 4 is a partial vertical sectional view showing the outer sleeve of said string spool shaft.
Figure 6A:
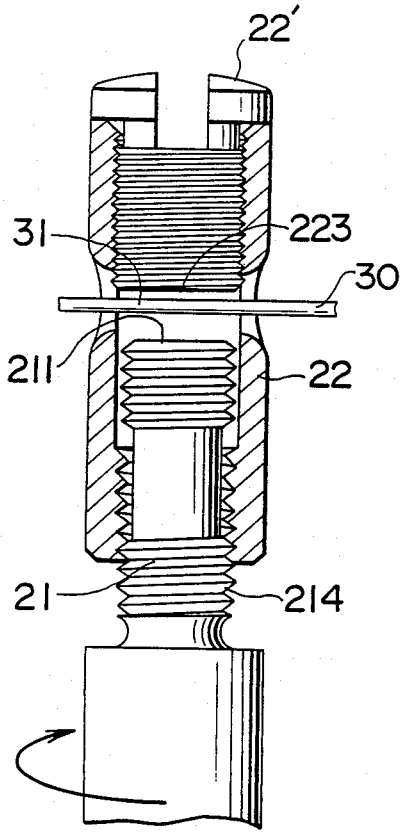
FIGS. 6A and 6B are respectively a vertical sectional view illustrating the operation of the tuning peg in accordance with the present invention.

The outer sleeve 22 for the tuning peg is mounted on said core shaft 21. This outer sleeve 22, as shown in FIGS. 1 and 4, is provided with the string passing hole 221 which is open in the orthogonal direction to the axis at its trunk part and the internal thread part 222 which engages with the threaded pulling part 214 of said core shaft 21 at the inside surface of the lower part, and the outer sleeve 22 is partly thread-fitted to said threaded pulling part 214, as shown in FIG. 6A and said outer sleeve 22 is thus set.

Figure 2:
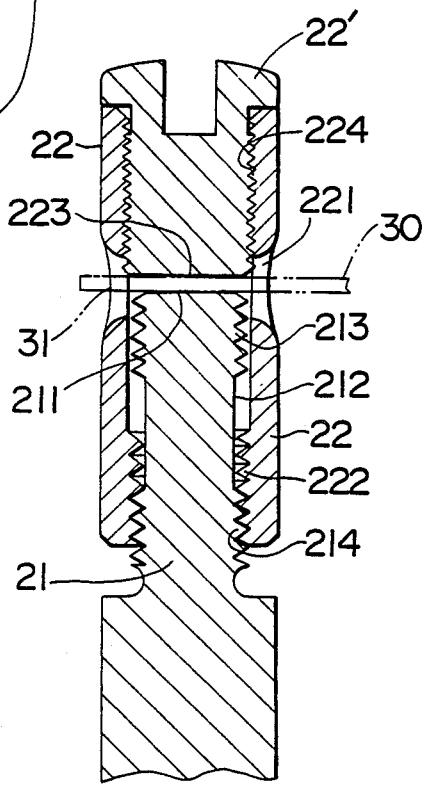
FIG. 2 is a vertical sectional view showing the string spool shaft of said tuning peg.

To set the outer sleeve 22 as described above, said internal thread part 222 need be able to pass through said threaded guide part 213 while being kept engaged with this threaded guide part 213. When the outer sleeve 22 is set, said outer sleeve 22 is held by that the internal wall of the outer sleeve 22 slightly contacts the threaded guide part 213 as shown in FIG. 2 and prevented from falling off in the axial direction by that the threaded guide part 213 is located at a position above the internal thread part 222.

The ceiling surface of the string passing hole 221 of said outer sleeve 22 is formed as the string pushing surface 223 and said string passing hole 221 is provided at a position where the string pushing surface 223 comes in contact with the string receiving surface 211 of said core shaft 21 when said outer sleeve 22 lowers from the setting position described above.

Figure 3:
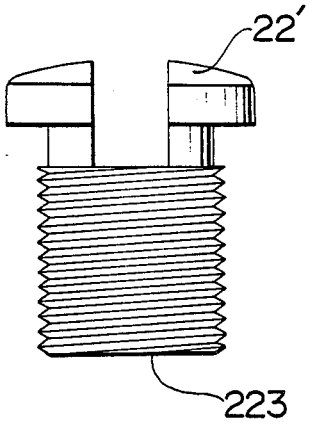
FIG. 3 is a front view showing the locknut of said string spool shaft.

Said string pushing surface 223 in the embodiment is formed with the bottom of locknut 22' as shown in FIGS. 1 and 3 and therefore the upper end of the outer sleeve 22 is open to insert the locknut 22' and the internal thread part 224 for thread-fitting the locknut 22' is provided on the internal surface of said outer sleeve 22.

Since the tuning peg in accordance with the present invention is as described above, the outer sleeve 22 is set so that the internal thread part 222 passes through said threaded guide part 213 and slightly engages with the threaded pulling part 214 of said core shaft 21 as shown in FIG. 6A and, under this condition, the string end 31 is manually passed through the string passing hole 221.

In such configuration, the string end 31 is extended inside the outer sleeve 22 so that its upper side is kept contacted with the string pushing surface 223 and its lower side is kept away from the string receiving surface 211.

When the core shaft 21 is rotated by operating said knob 11, the outer sleeve 22 is pulled down by rotation of the threaded pulling part 214 and rotates in conjunction with the core shaft 21 at the end point of lowering movement.

Figure 6B:
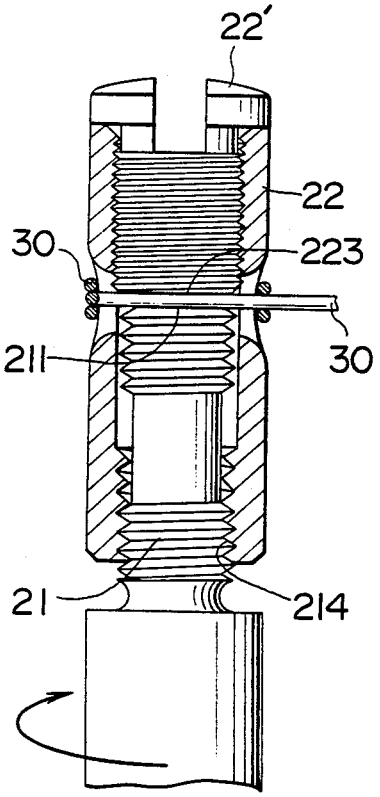

When the outer sleeve 22 thus finishes lowering, the string 30 is wound around the external surface of the outer sleeve 22 from the timing when the outer sleeve 22 starts the rotation in conjunction with the core shaft 21 since the string end 31 is held and fixed by and between the string pushing surface 223 and the string receiving surface as shown in FIG. 6B.

The tuning peg in accordance with the present invention is not limited to said embodiments and various variations and modifications of said embodiments are allowed within the range which does not deviate from the claims and spirit of the present invention.

What is claimed is:

1. A tuning peg for stringed instruments comprising a manually-operated knob and a string spool shaft, said string spool shaft having a core shaft which is rotated by operating said knob and an outer sleeve which is externally mounted on said core shaft, said core shaft having a string receiving surface at its top surface and a threaded pulling part at least at its lower part, said outer sleeve being provided with an internal thread part which is thread-fitted to said threaded pulling part at least at its lower inside surface and a string passing hole at its trunk part, and the internal ceiling of said string passing hole being formed as a string pushing surface, wherein said knob is rotated after the string end is inserted through said string passing hole to make said string pushing surface contact said string receiving surface to hold and fix the string onto said string receiving surface under a certain pressure.

2. A tuning peg in accordance with claim 1, wherein a locknut is thread-fitted to the upper end of said outer sleeve and the string pushing surface is formed by the bottom surface of said locknut inside said outer sleeve.

3. A tuning peg for stringed instruments comprising a manually-operated knob and a string spool shaft, said string spool shaft having a core shaft which is connected to said knob and rotated by rotation of the knob and an outer sleeve which is externally mounted on said core shaft, said core shaft having a string receiving surface at its top surface and a threaded pulling part at its lower part and being provided with a threaded guide part which is positioned with a diameter-reduced part above said threaded pulling part, said outer sleeve being provided with an internal thread part which engages with said threaded guide part and said threaded pulling part at its lower internal surface and a string passing hole at the trunk part of said outer sleeve in an orthogonal direction to the axis of said outer sleeve, and the internal ceiling of said string passing hole being formed as a string pushing surface, wherein the outer sleeve is prevented from falling off from the core shaft by the threaded guide part after the internal thread part of said outer sleeve passes through said threaded guide part, and the string is held and fixed at said string receiving surface under a certain pressure by rotating said knob to make said string pushing surface contact said string receiving surface after the string end is inserted through said string passing hole.

4. A tuning peg in accordance with claim 3, wherein a locknut is thread-fitted to the upper end of said outer sleeve and said string pushing surface is formed by the bottom surface of said locknut in said outer sleeve.

* * * * *